US010239079B2

(12) United States Patent
Ränsch et al.

(10) Patent No.: US 10,239,079 B2
(45) Date of Patent: Mar. 26, 2019

(54) DEVICE INTENDED TO CONTAIN AND DISPENSE A COSMETIC SUBSTANCE

(71) Applicant: INTUISKIN, Crolles (FR)

(72) Inventors: Pascal Ränsch, Meylan (FR); David Moulinier, Villeurbanne (FR)

(73) Assignee: INTUISKIN, Crolles (FR)

( * ) Notice: Subject to any disclaimer, the term of this patent is extended or adjusted under 35 U.S.C. 154(b) by 39 days.

(21) Appl. No.: 15/506,324

(22) PCT Filed: Sep. 4, 2015

(86) PCT No.: PCT/FR2015/052345

§ 371 (c)(1),
(2) Date: Feb. 24, 2017

(87) PCT Pub. No.: WO2016/034826

PCT Pub. Date: Mar. 10, 2016

(65) Prior Publication Data

US 2017/0252763 A1 Sep. 7, 2017

(30) Foreign Application Priority Data

Sep. 4, 2014 (FR) ..... 14 58291

(51) Int. Cl.
*B05B 11/00* (2006.01)
*A45D 33/26* (2006.01)
(Continued)

(52) U.S. Cl.
CPC ..... *B05B 11/308* (2013.01); *A45D 33/26* (2013.01); *A45D 34/00* (2013.01);
(Continued)

(58) Field of Classification Search
CPC ..... B05B 11/308
(Continued)

(56) References Cited

U.S. PATENT DOCUMENTS 4,736,871 A * 4/1988 Luciani ..... B65D 51/248 222/25
6,542,568 B1 * 4/2003 Howes, Jr. ..... A47K 5/1217 377/16
(Continued)

FOREIGN PATENT DOCUMENTS

FR 2895377 6/2007
WO 2007074305 A1 7/2007

OTHER PUBLICATIONS

International Search Report conducted in International Application No. PCT/FR2015/052345, dated Nov. 20, 2015.

*Primary Examiner* — Jeremy Carroll
(74) *Attorney, Agent, or Firm* — Meunier Carlin & Curfman LLC

(57) ABSTRACT

The invention relates to a device intended to contain and dispense a cosmetic substance, said device comprising: a container that forms a leaktight volume having an orifice through which the cosmetic substance is introduced so as to be stored temporarily in said leaktight volume; a closure means for shutting off said orifice in the container; characterized in that said closure means has: a detection member for detecting actuation of said closure means with a view to taking said cosmetic substance; a communications interface for transmitting the information output by said detection member to an external data server.

11 Claims, 2 Drawing Sheets

(51) Int. Cl.

| | |
|---|---|
| ***A45D 40/18*** | (2006.01) |
| ***A45D 34/00*** | (2006.01) |
| ***A45D 40/00*** | (2006.01) |
| ***B65D 47/12*** | (2006.01) |

(52) U.S. Cl.
CPC ..... *A45D 40/0075* (2013.01); *A45D 40/18* (2013.01); *B05B 11/3001* (2013.01); *B05B 11/3028* (2013.01); *B65D 47/122* (2013.01)

(58) Field of Classification Search
USPC ..... 222/238
See application file for complete search history.

(56) References Cited

U.S. PATENT DOCUMENTS

| | | | | |
|---|---|---|---|---|
| 8,342,369 | B2 * | 1/2013 | Hsu | A47K 5/1202 222/309 |
| 8,573,443 | B2 * | 11/2013 | Natterer | B05B 9/043 222/173 |
| 8,976,031 | B2 * | 3/2015 | Ophardt | B05B 11/308 340/573.1 |
| 2014/0253336 | A1 * | 9/2014 | Ophardt | A47K 5/1202 340/573.1 |
| 2014/0299169 | A1 * | 10/2014 | Schneider | H01L 35/02 136/201 |
| 2015/0325769 | A1 * | 11/2015 | Hayashi | H01L 35/32 320/101 |

* cited by examiner

DEVICE INTENDED TO CONTAIN AND DISPENSE A COSMETIC SUBSTANCE

This application is a national stage filing of PCT Application PCT/FR2015/052345, filed on Sep. 4, 2015, and claims the benefit of French Application FR 1458291, filed Sep. 4, 2014, the contents of each are hereby incorporated by reference in their entirety.

ART

This invention relates to the art of devices intended to contain a cosmetic substance with a view to its storage and optimal use. Such devices also allow this cosmetic substance to be dispensed daily or occasionally as a function of a predetermined procedure for use as a function of recommendations for use, and/or after analyzing skin needs. Such a cosmetic substance can therefore be presented in the form of a cream, of a lotion or of an emulsion, and in particular also have therapeutic action to allow care of a pathology.

Accordingly, the invention will be illustrated below as being a device intended to contain and dispense a cosmetic substance but will not be limited to creams or makeup, but could also relate to the art of dispensing of drugs in cream, capsule or tablet form.

PRIOR ART

Generally, devices that can contain and dispense a cosmetic substance are known in the prior art. Such devices, such as flasks, bottles or dispensers, include a container forming a leaktight volume equipped with an orifice that allows it to be filled with the substance. These devices also include a closure means to shut off the orifice, at least temporarily, while it is transported and/or stored with a view to preserving the cosmetic substance.

However, this type of device presents no interactivity, and consequently the user of the cosmetic substance cannot be incited to change its use of the cosmetic substance, for example if this does not correspond to the optimal procedure for use.

The invention targets more particularly a device of this type that also allows collection of information with a view to monitoring how the cosmetic substance is removed by a user.

WO2007/074305 proposes such a device in which the closure member of the container includes in particular a sensor configured to detect whether the closure member of the container is removed or not from the container, corresponding to information on container opening or closure. This opening/closure information output by the sensor is in particular interpreted as corresponding to one use of the product. It is understood that such information is not reliable and does not allow correct interpretation as to actual use or non-use of the product by the user. Indeed, it is understood that the user may remove the closure member, therefore open the container, without taking any substance at all.

DISCLOSURE OF THE INVENTION

Accordingly, an object of the invention is to guarantee correct and optimal use for each user of the cosmetic substance contained in such a device.

Another object of the invention is to propose a solution that allows estimation of the quantity of substance remaining or actually used by the user.

Therefore the invention relates to a device intended to contain and dispense a cosmetic substance. Such a device includes at least:

- a container allowing formation of a volume, preferably leaktight, intended to contain the cosmetic substance. This container in particular includes an orifice through which the cosmetic substance may be added to be stored temporarily in the volume;
- a dispensing member whose manual actuation causes the removal, through the dispensing member itself, of a dose of the cosmetic substance through the orifice of the container;

According to the invention, the dispensing member further comprises:

- a detection member for the manual actuation of the dispensing member; and
- a communication interface allowing the information output by said detection member to be sent to an external data server.

In other words, a device in accordance with the invention allows the detection, via the detection member integrated into the dispensing member, of actuation of the dispensing member and therefore the actual removal of the cosmetic substance contained in the volume.

Preferably, the detection member can generate, at each detection of the manual actuation of the dispensing member that causes the removal of the dose of cosmetic substance, a signal representative of this actuation.

Such a detection member can be presented in different forms and in particular be a sensor for mechanical and/or electrical contact or also be a sensor without a contact such as an optical or magnetic technology sensor.

Preferably, all or part of the mechanical components integrated into or forming the dispensing member, such as the detection member, the control member or the extraction member are energetically autonomous.

The communication interface allows communication of information generated by the detection member to an external data server. Of course, such a communication interface may be presented in different forms, and in particular it can be connected to a data network by a radio link, according to an appropriate protocol, or via an external modem or directly via a GSM network.

In practice, the information related to the actuation of the dispensing member, and therefore to the removal and use of the substance, may be treated by remote IT resources, such as a data server, and the result of this treatment may be viewed on local IT resources, such as a personal computer, a tablet, or a smartphone. In this case, an application executed on the tablet or the telephone may indicate to the user if the use of the substance is in accordance with the prescriptions that led to the choice of the substance. As an example, if the user employs the substance at a lower frequency than that which was recommended, the application may indicate this to the user. Moreover, the application may also estimate the total quantity of substance removed from the first use of the product, or also the quantity of substance remaining in the container.

In practice, the dispensing member may comprise a control member coupled with an extraction member 35. In this specific case, the manual actuation of the control member causes at least the removal by the extraction member through the orifice of the container, of a dose of the cosmetic substance contained in the volume. Of course, the detection member is in this case shaped to detect this manual actuation of the control member.

According to one variant, the dispensing member is a plunger pump 36 provided with a push button 37. The push button thereby constitutes the control member that can be manually actuated and whose actuation is detected by the detection member.

For example, the pump-type dispensing member may be formed of a pipette (or plunger tube) configured to be introduced into the volume via the orifice of the container to allow the removal of the substance. This pipette is coupled with a plunger pump linked to a push button, allowing removal by suction and to deliver to the user a predefined dose of substance, when the push button is actuated. Such a pump can be screwed or clicked on at the container's orifice.

The detection member may for example be configured to detect an activation position of the control member, distinct from a rest position. Accordingly, each detection of pump actuation by the detection member, and more precisely of the control member, corresponds to information about removal or dispensing of a dose of the cosmetic substance.

Advantageously, the dispensing member is of the type without air return, commonly known as an "airless pump" or an "air-free pump."

According to another variant, the dispensing member is a pump presenting in the form of a pipette provided with an elastic nipple (or pear), where the nipple constitutes the control member.

Regardless of the variant, the dispensing member may also constitute a closure member (or closure means) for the container allowing the orifice of the container to be shut off. Moreover, the dispensing member may be mounted fixed or detachably on the container.

When the dispensing member is mounted as a removable stopper on the container, the dispensing member may in particular be screwed or clicked onto the container to prevent any accidental disconnection of the stopper from the container. Moreover, the detection member may also serve for the detection of closure and/or opening of the container. Of course, it is perfectly possible to integrate another detection member in the dispensing member, dedicated to the detection of the closing and opening of the container.

In this case, this other detection member may consist of a presence or contact sensor that will allow determination of the presence or absence of the dispensing member at the orifice of the container.

For example, the dispensing member may comprise a fixation ring that is shaped to engage with the edges of the orifice and ensure the leaktight sealing of the container. In the case for example of a push button pump, the control member may be mounted slidably to the interior of the fixation ring and the detection member may be arranged inside this fixation ring.

Advantageously, the dispensing member may further comprise a module for generating a signal representative of timing information relating to each actuation of the dispensing member that causes the removal, and/or relating to opening/closing the container. For example, the module for generating such a signal may be a microcontroller configured to generate a clock signal. According to one variant, this clock-generating module may also be a quartz-based electronic component or a passive component.

For example, when the user of the device removes the cosmetic substance with a view to its use, the microcontroller allows generation of a timing information such as the date and time of use, or also information representative of the quantity of substance removed, for example in the case of a pump dispenser. Such an arrangement is in particular advantageous when the data collected by the detection member is temporarily stored in the device before being sent to the external data server.

Accordingly, in practice, the dispensing member further comprises a memory allowing at least temporary storage of information output by at least the detection member upon each actuation of the dispensing member, which causes the removal of the substance, whereby the communication interface allows data stored in the memory to be sent to the external data server.

Of course, the memory may also store the information output by the other detection member, or also the clock-generating module or microcontroller.

Accordingly, each of the uses of the cosmetic substance is recorded in the memory and the timing and removal information allow later determination of the frequency of use or also the quantity of substance removed or remaining in the container. They also allow checking of a predetermined protocol for the use of the cosmetic substance. Such a memory thereby allows temporary storage of information output by the detection member and/or the microcontroller when the communication interface is not connected to the network in order to send this information to the external data server.

According to a specific embodiment, the closure means may include an identification member of the user and the memory may store information output by the identification member upon each actuation of the dispensing member, and in particular of the control member.

Such an identification member thereby allows verification of the identity of the device user. Such an embodiment is in particular advantageous when several people, for example in a single family, use the same cosmetic substance. Such an identification member may in particular be presented in the form of a fingerprint detector or more simply a force or pressure detector so as to distinguish different users in a single house using the device. It may also be a code to enter using keys present on the closure means.

According to one specific embodiment, the device may include a unique identification code, such a code being stored in the memory integrated in the dispensing member and sent with each transmission of the data stored in the memory to the external data server.

In other words, each device includes a unique identification code to ensure that the product used does correspond to the one that was sold to the user. In fact, a user may use different cosmetic substances during the day and consequently, information may be sent to the external server from at least two different devices containing distinct cosmetic substances. It may therefore be important to identify each cosmetic substance with a unique identification code.

In addition, the unique character of the device identifier eliminates cumbersome pairing protocols.

Advantageously, the dispensing member may include an autonomous energy source, preferably self-generating.

In other words, the energy source is integrated with the dispensing member and allows all or part of the components integrated in the dispensing member that require electrical energy to be powered. The energy source may for example power the microcontroller and/or the memory and/or the communication interface with electrical energy. Such an autonomous energy source may be presented in different forms, and for example in the form of a rechargeable or non-rechargeable battery, associated for example to a photovoltaic generator.

In practice, according to one variant, the dispensing member may comprise a thermoelectric generator that can produce electrical energy upon each contact of a part of the user's body with the control member.

According to another variant, the autonomous energy source may be produced by manual actuation of the pump-type dispensing member. Specifically, the dispensing member may comprise an electromechanical generator coupled with the control member and that can produce electrical energy upon each manual actuation of the control member.

In this case, each time the device is used, the mechanical actuation of the pump both detects removal of the cosmetic substance and sends this information to an external data server. It is the mechanical action of pressure on the pump that is transformed into electrical energy, allowing the information to be sent to the external server.

According to a specific embodiment, the communication interface may use a wireless communication protocol.

In this manner, it is not necessary to connect the device to a network-connected support. In addition, the information may be sent at each use or also periodically, such as for example once a day, when the device includes a memory allowing the information output by the detection member to be temporarily stored.

Information output by the detector and/or clock-generating members may occur as follows.

During detection of a removal of a dose of substance by the corresponding detection member, a signal representative of this event is generated by the detection member.

Moreover, simultaneous with the actuation of the dispensing member which caused this removal, the energy source generates sufficient electric energy to allow the communication interface to send this information to the external server when it is available or, when the server is not available, to allow this information to be stored in the memory for sending later, in particular the next time the dispensing member is actuated.

Moreover, simultaneously with the detection of the removal, a clock signal representative of a piece of timing information for this removal may also be generated by clock generator. This clock signal is then associated with the signal generated by the detection member during data transmission by the communication interface and storage in the memory.

On the same principle, the information on opening/closing the container may also be sent to the remote server or stored in the memory.

Accordingly, in so far as the dispensing member is sized to remove and/or extract a predefined quantity of substance, it is possible to estimate the quantity of substance removed or remaining in the container may be obtained.

It is even possible, depending on the type of sensor used to detect the actuation, to know whether the dose actually delivered is equal to or less than a maximum predefined dose that can be delivered by the dispensing member.

BRIEF DESCRIPTION OF FIGURES

The methods for implementing the invention and its advantages will become more apparent from the following disclosure of the embodiment that follows, given by way of a non-limiting example, supported by the figures in which.

DETAILED DESCRIPTION OF THE INVENTION

As already stated, the invention relates to a device intended to contain and dispense a cosmetic substance.

Figure 1:
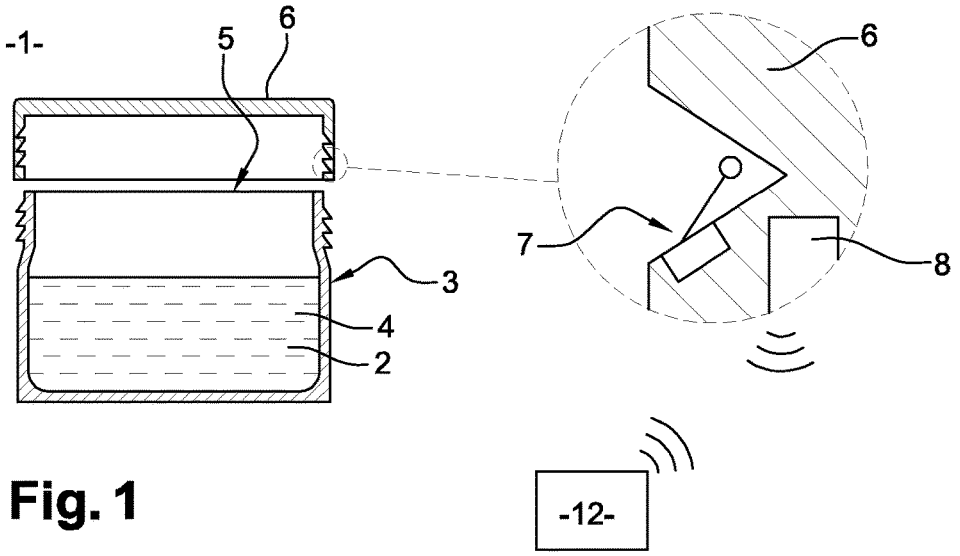
FIG. 1 is a cross-sectional view of a first variant of a device, according to the invention.

As shown in FIG. 1, the device 1 includes a container 3 forming a leaktight volume 4 and presenting an orifice 5 to allow leaktight volume 4 to be filled with cosmetic substance 2.

Moreover, and as shown, the device 1 also includes a closure means 6 shown in the form of a removable stopper and including an inner thread to engage by screwing with a complementary thread on container 3.

As shown, the threading of the closure means 6 may include a detection member 7, here shown in the form of a mechanical contact sensor, and allowing detection of actuation of the closure means 6. In fact, when the removable stopper is removed from the container 3, the detection member 7 then detects the absence of the facing thread to infer that the container has been opened, and therefore that the cosmetic substance 2 that it contains is removed.

Moreover, a communication interface 8 then allows a piece of information output by the detection member 7 to be sent to an external data server 12. It is thereby possible to study the use profile of a cosmetic substance 2 contained in such a device 1. It is then possible to automatically check that the person uses the cosmetic substance 2 in accordance with a predetermined protocol.

It can then also be envisaged to alert the user of a use of the cosmetic substance 2 that is not in accordance with the initial prescription, with the aim of changing the user's behavior.

Figure 2:
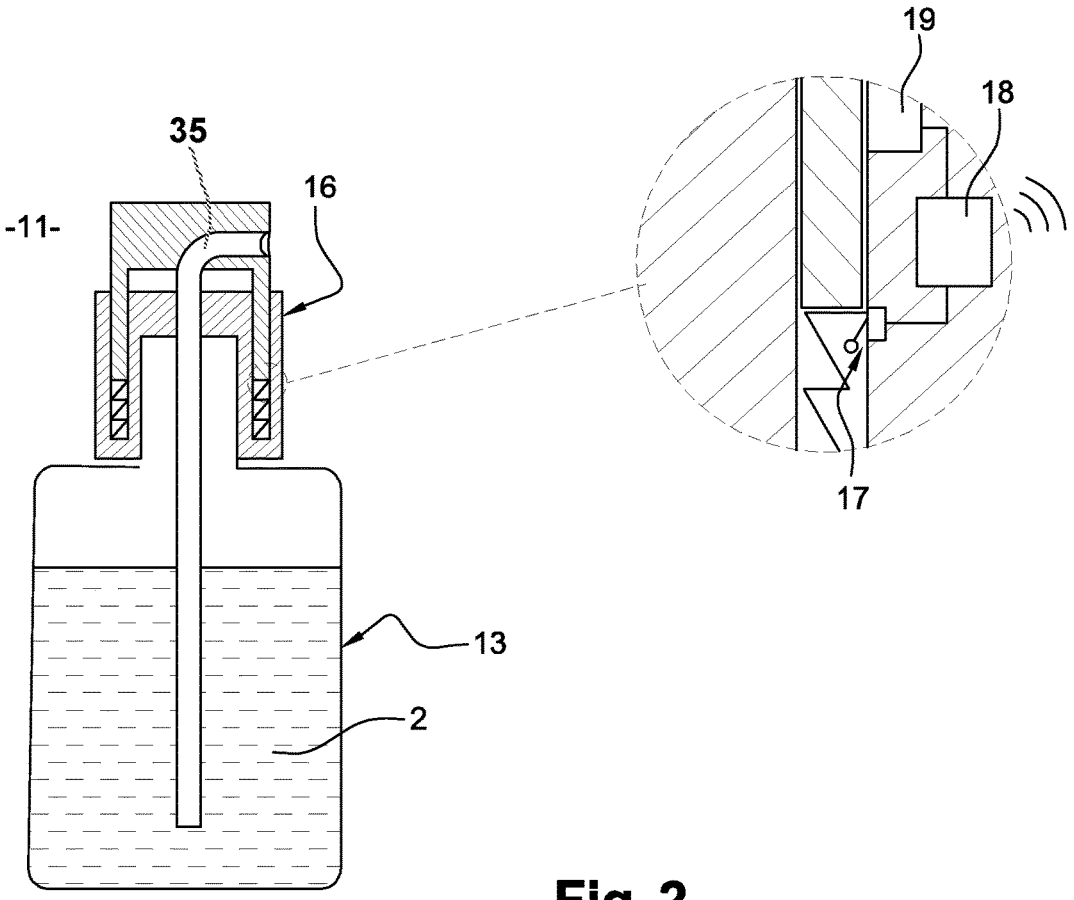
FIG. 2 is also a cross-sectional view of a device according to a second variant, according to with the invention.

As shown in FIG. 2, a device 11 may also include a closure means 16 presenting in the form of a pump-type dispensing member. Such a closure means 16 is arranged at a filling orifice of the container 13 with the cosmetic substance below.

As shown in the detail view, the closure member 16 includes a detection member 17 so as to detect movement of the pump and therefore the removal of the cosmetic substance. The information output by the detection member 17 is then sent to the communication interface 18 so as to be communicated to the external server. As shown, this communication interface 18 may use a wireless communication protocol with the external data server.

Moreover, the closure means 16 may include an autonomous energy source 19 allowing for example to power the communication interface 18 with electric energy. Such an autonomous energy source 19 may, in this case, be directly produced by the manual actuation force of the pump-type dispensing member.

Figure 3:
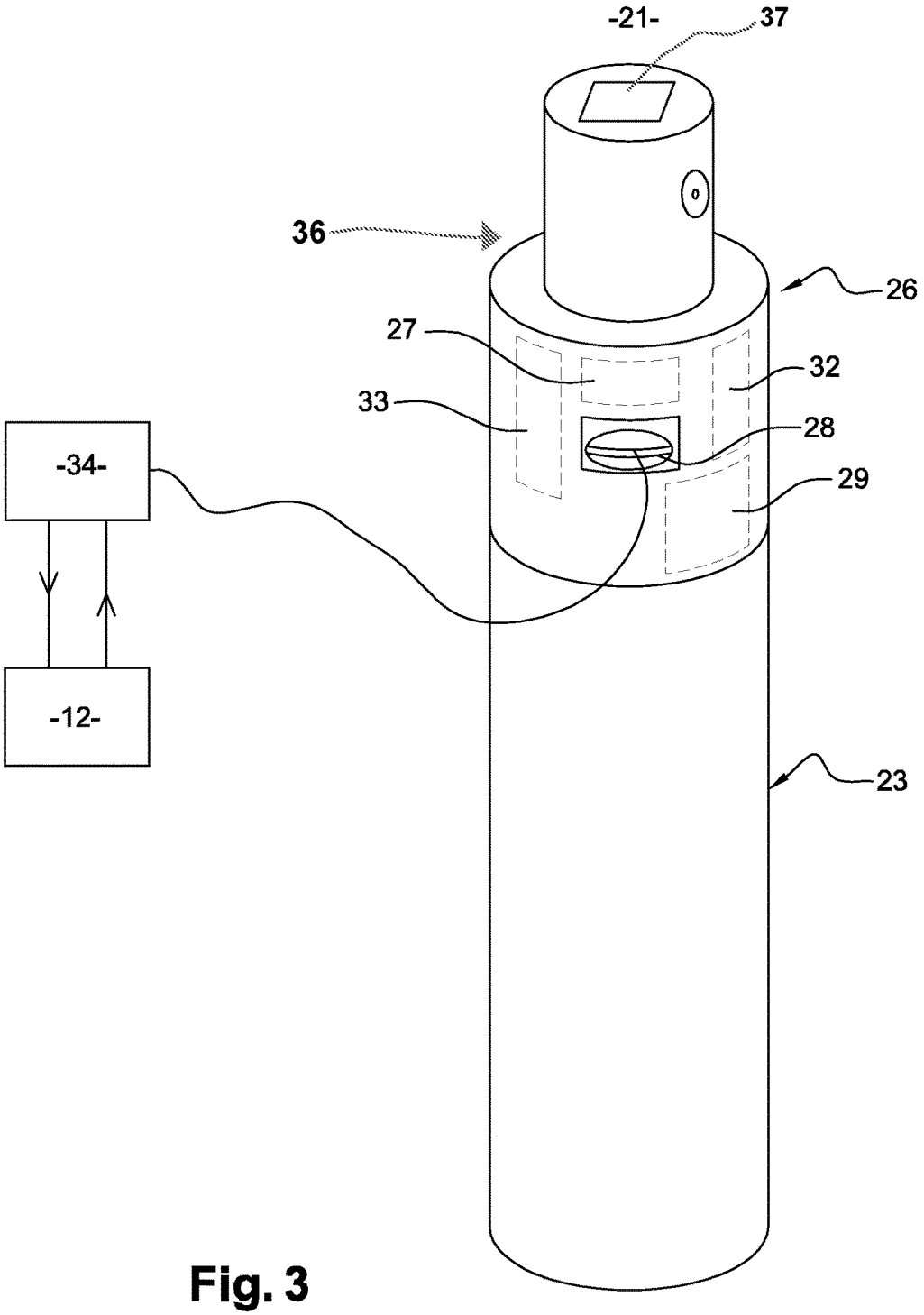
FIG. 3 is a perspective view of a third variant of a device, according to the invention.

As shown in FIG. 3, the device 21 may include a detection member 27 without contact, which may be for example an optical or magnetic sensor so as to detect the actuation of the closure means 26.

Moreover, the communication interface 28 may also be presented in the form of an electrical connection into which a conductor wire may be inserted. The conductor wire then allows the device to be connected to a modem 34. Such a modem 34 may also be connected for example by wire to the external data server 12.

Moreover, such a device 21 may include a memory 33 and a microcontroller 32. Such a microcontroller 32 allows a clock signal to be generated to record in the memory 33 a piece of timing information specific to each actuation using the closure means 26. Once the device 21 is connected to the modem 34 via the communication interface 28, the data contained in the memory 33 is sent to the external server 12.

Moreover, such a device 21 may also include an autonomous energy source 29, here shown in the form of a battery that may be rechargeable. Connecting the communication interface 28 with the modem 34 may then allow the battery to be recharged.

It results from the above that a device in accordance with the invention presents many advantages, and in particular:

- it allows a procedure for use for a cosmetic substance to be checked and the user or family member to be alerted when the procedure is not followed;
- it also allows for checking that the user of the cosmetic substance is indeed the person for whom this substance is intended;
- it may be used for other applications, and in particular for substances that allow pathologies to be treated, such as creams, lotions or also any type of drugs such as tablets, capsules or pills in particular.

The invention claimed is:

1. A device intended to contain and dispense a cosmetic substance, said device comprising:

- one container allowing formation of a volume intended to contain the cosmetic substance;
- one dispensing member whose manual actuation causes the removal, through the dispensing member, of a dose of the cosmetic substance through an orifice of the container;
- a detection member for the manual actuation of the dispensing member; and
- a communication interface configured to send the information of said detection member to an external data server, wherein the dispensing member further comprises:
  - a thermoelectric generator that can produce electrical energy upon each contact of a part of the user's body with the control member; or
  - an electromechanical generator coupled with the control member and that can produce electrical energy upon each manual actuation of the control member.

2. The device according to claim 1, wherein the dispensing member comprises a control member coupled with an extraction member, whereby the manual actuation of the control member causes at least the removal by the extraction member through the orifice of the container, of a dose of the cosmetic substance contained in the volume, the detection member being shaped to detect said manual actuation of the control member.

3. The device according to claim 2, wherein the dispensing member is in the form of a plunger pump provided with a push button, said push button constituting the control member.

4. The device according to claim 1, wherein the dispensing member constitutes a closure member configured to close said orifice of the container.

5. The device according to claim 1, wherein the dispensing member further comprises a thermoelectric generator that can produce electrical energy upon each contact of a part of the user's body with the control member.

6. The device according to claim 1, wherein the dispensing member further comprises an electromechanical generator coupled with the control member and that can produce electrical energy upon each manual actuation of the control member.

7. The device according to claim 1, wherein the detection member can generate, upon each detection of said manual actuation of the dispensing member that causes the removal of the dose of cosmetic substance, a signal representative of said actuation.

8. The device according to claim 1, wherein the dispensing member further comprises a memory allowing at least temporary storage of information output by at least the detection member upon each actuation of the dispensing member that causes the removal, whereby said communication interface allows data stored in the memory to be sent to said external data server.

9. The device according to claim 8, further comprising a unique device identification code stored in said memory and sent with each transmission of the data stored in the memory to said external data server.

10. The device according to claim 1, wherein the dispensing member further comprises a module for generating a signal containing a timing information upon each actuation of the dispensing member that causes said removal.

11. The device according to claim 1, wherein the communication interface uses a wireless communication protocol.

* * * * *